United States Patent [19]

Lambert, Jr.

[11] 4,239,210

[45] Dec. 16, 1980

[54] ARM CURL MACHINE

[76] Inventor: Lloyd J. Lambert, Jr., c/o Dynamics Health Equipment Manuf. Co., Inc. 1538 College Ave., South Houston, Tex. 77587

[21] Appl. No.: 7,966

[22] Filed: Jan. 31, 1979

[51] Int. Cl.[3] ..... A63B 21/06

[52] U.S. Cl. ..... 272/118; 272/134

[58] Field of Search ..... 272/144, 117, 118, 123, 272/125, 134, 93

[56] References Cited

U.S. PATENT DOCUMENTS

| | | | |
|---|---|---|---|
| 3,268,224 | 8/1966 | Freshour | 272/117 X |
| 3,912,261 | 10/1975 | Lambert | 272/134 X |
| 4,098,502 | 7/1978 | Faust | 272/144 |
| 4,149,714 | 4/1979 | Lambert | 272/144 X |

*Primary Examiner*—George J. Marlo
*Attorney, Agent, or Firm*—Victor J. Evans & Co.

[57] ABSTRACT

Disclosed herein is a machine for use in exercising the upper arm area by performing what is known as an arm curl. The machine is defined by a seating area, a pivotable arm support table, and a bar fashioned to comfortably engage the hands of the user. This provides a rotation about an axis which is transferred to a cam whose configuration causes proportional resistance throughout the exercise for maximum arm and shoulder development. The cam is operatively connected to weights through a chain drive and the increasing radius of the cam is that which provides the proportional change and resistance.

9 Claims, 3 Drawing Figures

25
28
29
30
31
10
1
4
5
7
14
3
13
27
9
2
28
31
15
20
32
28
31
18
18
17
21
16

ARM CURL MACHINE

BACKGROUND OF THE INVENTION

The science of weight lifting mechanics has until the present been quite primitive especially when considering the exercise known as the arm curl. Prior art devices of which applicant is aware for exercising the arm in a curling motion merely comprises a standard bar bell set in which the curling exercise is done while the user is standing, or the use of a dumb bell on an inclined board in which individual arms are exercised separately.

In the first case, there is a tendency to develop an oscillatory rocking motion with the body which tends to translate this momentum to serve as an aid in performing the exercise since by rocking back and forth, the bar bell can benefit from this motion and effectively decrease the weight and work done. Further, it should be apparent that as the arm pivots at the elbow, the mechanical advantage of the arm and its associated muscles changes as a function of its position to the extent that the difficulty of the exercise changes and varies as a function of the upper arm's relationship to the forearm. When using dumb bells on an inclined board, the advantage of the rocking motion has been minimized, but an additional problem is encountered in which the dumb bell can be allowed to rotate to provide torsion on the arm and thereby affect the mechanical advantage.

SUMMARY AND OBJECTS OF THE INVENTION

Accordingly, the foregoing defects in the prior art have been remedied by the ensuring structure wherein it should be noted that the machinery according to the present invention has as an object and result the ability to negate the above noted torsion.

A further object provides the elimination in a rocking or oscillatory motion which will change the work done by the exerciser due to momentum.

It is still another object to provide an apparatus in which an increase in the mechanical advantage of the arm muscles is counteracted against by the use of a cam which causes the work done thereagainst to vary as a function of the cam's radius as it changes.

These and other objects will be made manifest, including the additional safety provided by the equipment, noting that the exerciser is physically removed from his association with the weights thereby decreasing the likelihood of injury therewith.

The ensuing description of the drawings and appended drawings will make clear how the foregoing objects are achieved.

DESCRIPTION OF THE PREFERRED EMBODIMENT

Figure 1:
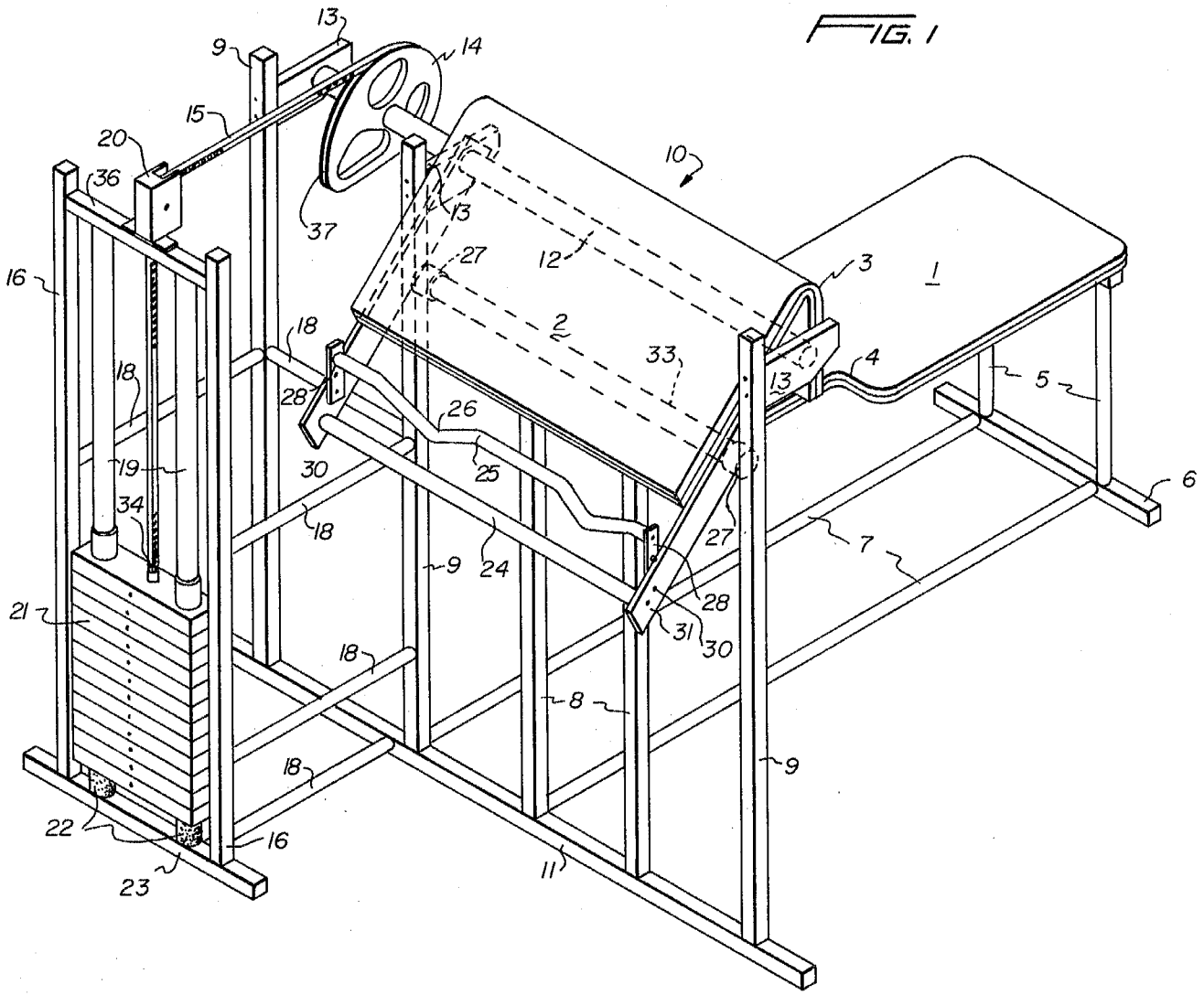
FIG. 1 is an isometric view of the apparatus according to the present invention.

Referring to the drawings now, wherein like reference numerals refer to like parts throughout the several drawings, reference numeral 10 is directed to the arm curl machine according to the present invention.

This arm curl machine 10 can generally be regarded as being provided with a seating area 1 which is provided with a narrowed neck portion 4 proximate to the actual apparatus. This seat as shown in the drawings, is supported by vertically upstanding rod members 5 and 8, and each pair of these vertically upstanding rod members finds support in base members 6 and 11 respectively. Additional rigidification is provided by interconnecting base members 6 and 11 through the rods 7 as shown in FIG. 1. The pair of vertically upstanding members 8 terminate in a cross beam 33 the extremities of which are provided with rubber stop bumpers 27 whose function will be explained hereinafter. The opposed faces of stop bumpers 27 are supported via exterior vertically upstanding rod members 9 whose lower extremities find support in base member 11 and serve to support a portion of the weight lifting apparatus.

The top vertical extremities of vertically upstanding rod members 9 are provided with horizontally inwardly extending (relative to the seating area 1) support shoulders 13 which through bearing means serve to support a pivotable first shaft 12.

Extending outwardly and downwardly from the vertically upstanding rod members 9, opposite from the seating area 1, there is shown opposed planar rod members 31 affixed at one extremity to shaft 12 and terminating at the extremity remote from the shaft 12 is a second shaft 24 parallel thereto. Intermediate between these two shafts 12, 24, but substantially closer to shaft 24 is a hand bar 25 provided with two V-shaped indentations 26 which, in a preferred embodiment, are provided with knurled surfaces to serve as a hand grip for the user. Supported on the rod members 31 and extending over the entire extent between these two parallel shafts 12, 24 is a padded shroud 2 which terminates in a downwardly extending padded section 3 proximate to the seat 1 so that the exerciser is removed from any rotating parts and can benefit from the padded protective shroud 2 and padded section 3 by allowing his arms to rest thereagainst.

Shaft 12 extends in one direction beyond one support shoulder 13 and terminates finally in a third shaft support shoulder 13 disposed on a third vertical rod member 9 as shown in the drawing of FIG. 1. Disposed between these second and third vertical rod members 9 on the shaft 12 is a cam 14 from which a chain 15 extends and travels to a further support for the weights now to be defined. The chain 15 runs over a sprocket 32 (FIG. 2) protected by a shroud 20 which in turn is supported by a pair of vertically upstanding columnar members 16 and a horizontal base 23 having spaced-apart bumper springs mounted thereon. The top vertical extremities of the columnar members 16 are interconnected by means of the support brace 36 which also serves as the sprocket 32 support for the and shroud 32 and 20. Extending between the base member 23 and the top strut or support brace 36 are two vertically disposed circular bars 19 disposed between the two columnar members 16 and disposed on these two circular bars 19 there are provided a plurality of weights 21 whose magnitude is adjustable. The chain 15 after riding over the sprocket 32 extends downwardly and terminates in these weights 21. It should be noted that the weights 21 have a plurality of holes 40 therein and a corresponding pin (not shown) is inserted in the hole 40 which coacts with a rod disposed beyond a collar 34 at the terminal portion of the chain 15 so that appropriate alignment of the rod and the hole 40 within the weights 21 can variably select the amount of weight. Collar 34 at the terminal portion of the chain 15, as shown in FIG. 1 also serves to provide an adjustment in the chain tension by coaction against a threaded end disposed on the top extremity of the rod that rides within the weights 21. It should be apparent therefore that the collar 34 by rotation relative to the rod will extend or contract the length of the chain 15. The vertical rods 9 which surround the cam 14 are interbraced by means of a bar 18, similar bars extend between the columnar members 16 and these vertically upstanding rod members 9.

Figures 2, 3:
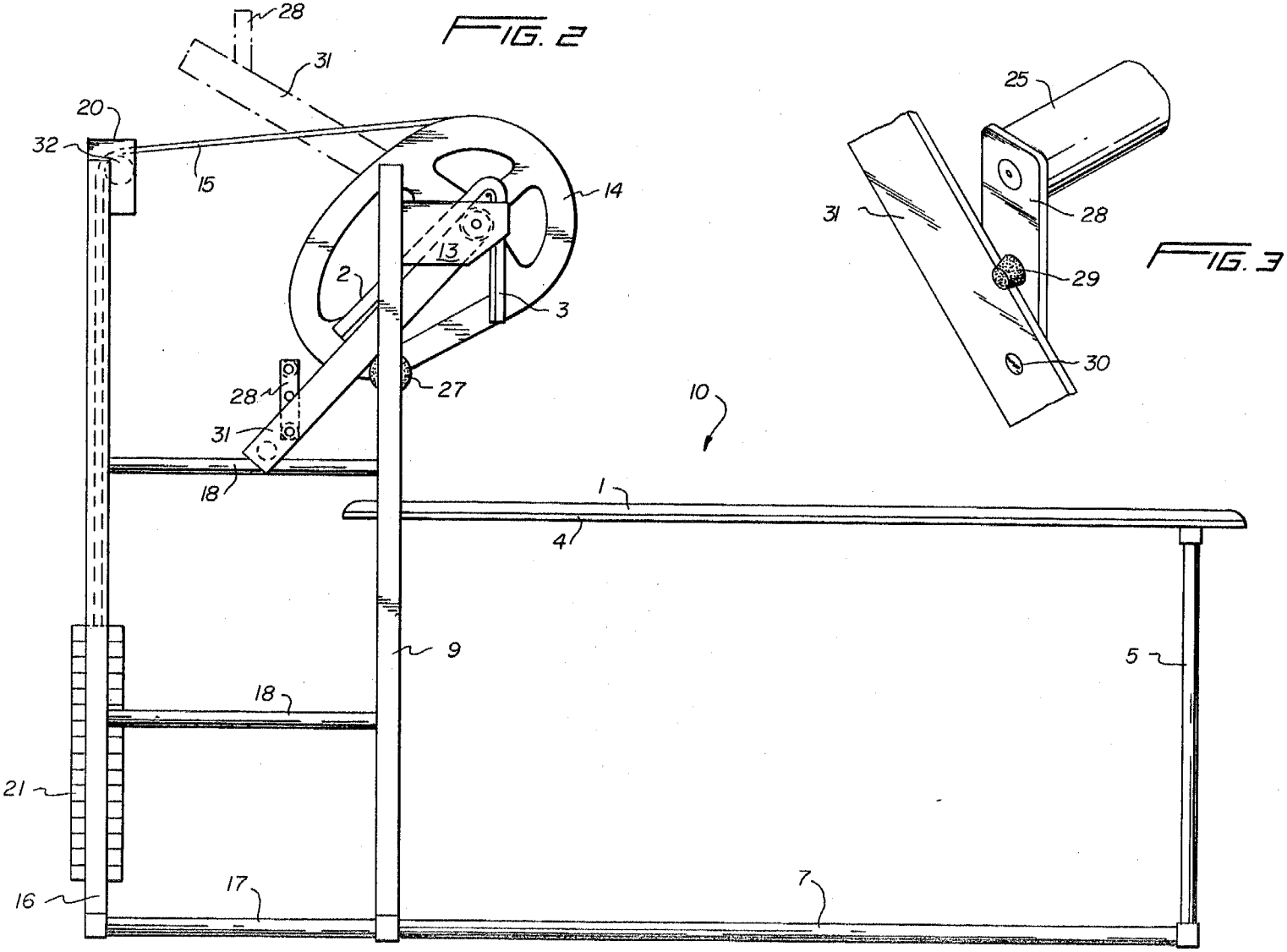
FIG. 2 is a side view thereof.
FIG. 3 provides a detailed showing of a portion of FIGS. 1 and 2 denoted by the reference numerals and referring specifically to the hand grip bar and its associated linkage.

FIG. 3 shows an aspect of the invention heretofor not discussed, and concerns the hand bar 25. It should be noted that the hand grip bar 25 is pivotally connected at the ends to the rod member 31 through bracket 28 at pivot points 30 and is rotatable within a limited range, as defined by a stopper 29. This allows for the user to angulate the bar 25 to a comfortable position to allow his wrists to correctly address the portion of the bar 24 and allow his forearms to become comfortably associated with the protective shroud 2 which is padded. number 2. It should also be apparent therefore that the stop bumpers 27 disposed on vertical rods 9 serve to stop the counterclockwise (relative to FIG. 2) rotation of the rod members 31, and the extent of counterclockwise rotation which is permissible will be determined by the vertical orientation of these stop bumpers 27.

As the exercise proceeds from the rest position shown in FIG. 1, to that which is shown in phantom in FIG. 2, the cam 14 will wind the chain 15 along a groove 37 and in doing so, the effective radius will increase because of the cam's specific configuration. This tends to provide an increase in work due to the longer moment arm and provide an additional progressive resistance of the exercise being performed.

Having thus described the invention it should be apparent that numerous structural modifications are contemplated as being a part of this invention as set forth hereinabove and as defined hereinbelow by the claims.

What is claimed is:

1. An arm curl machine comprising, in combination, a frame, a seat for an exerciser connected to said frame, a weight cage on said frame, weight means disposed in said weight cage for vertical movement between a rest position and an elevated position, stop means on said frame, hand grip means pivotally mounted on said frame for pivotal movement upwardly by said exerciser from a stop position defined by said stop means and drive means operatively connected to said hand grip means for moving said weight means from said rest position corresponding to the stop position of said hand grip means into said elevated position thereby providing an arm curl exercise for said exerciser.

2. An arm curl machine in accordance with claim 1 wherein said drive means includes a cam having a varying radius operatively connected to said weights means for progressively increasing the resistance to the pivotal movement of the hand grip means from the rest position to the elevated position by the exerciser.

3. An arm curl machine in accordance with claim 2 including a padded shroud disposed on said hand grip means in overlying relationship therewith for resting engagement by the arms of the exerciser during an arm curl exercise.

4. An arm curl machine in accordance with claim 3 wherein said padded shroud is of substantially inverted V-shaped configuration.

5. An arm curl machine in accordance with claim 3 wherein said hand grip means comprises a first shaft rotatably mounted on said frame, said cam being mounted on said first shaft for rotation therewith, a pair of rod members connected at one end to said first shaft in spaced-apart, parallel relationship, a second shaft having ends connected to said rod members adjacent the other side of said rod members in spaced-apart parallel relationship with said first shaft and a hand bar mounted on said rod members in substantially parallel relationship with said first and second shafts.

6. An arm curl machine in accordance with claim 5 including a pair of brackets each pivotally mounted on a respective one of said rod members and wherein said hand bar is connected at opposite ends to said brackets for rotation within a limited range.

7. An arm curl machine in accordance with claim 6 wherein said hand bar is provided with a pair of longitudinally spaced V-shaped indentations for accommodating the hands of the exerciser.

8. An arm curl machine in accordance with claim 6 wherein said stop means comprises a pair of spaced-apart bumpers engageable with a respective one of said rod members in said stop position of said hand grip means.

9. An arm curl machine in accordance with claim 2 including a sprocket rotatably mounted on said frame and a chain extending over said sprocket and connected at opposite ends to said cam and said weight means respectively.

* * * * *